United States Patent [19]

Cox et al.

[11] Patent Number: 4,698,472

[45] Date of Patent: Oct. 6, 1987

[54] MICROWAVE HEATING STAND WITH ELECTRICALLY ISOLATED REFLECTOR

[75] Inventors: David H. Cox, Robinsdale; David W. Andreas, Minneapolis, both of Minn.

[73] Assignee: Golden Valley Microwave Foods Inc., Eden Prairie, Minn.

[21] Appl. No.: 904,634

[22] Filed: Sep. 8, 1986

[51] Int. Cl.[4] ..... H05B 6/80

[52] U.S. Cl. ..... 219/10.55 E; 219/10.55 F; 426/107; 426/243; 99/DIG. 14

[58] Field of Search ..... 219/10.55 E, 10.55 F; 426/107, 110, 113, 241, 243, 234; 99/451, DIG. 14; 206/45.12, 45.2, 45.21, 45.31, 634, 830; 126/390

[56] References Cited

U.S. PATENT DOCUMENTS

| | | | |
|---|---|---|---|
| 2,612,596 | 9/1952 | Gross | 219/10.55 F |
| 2,993,633 | 7/1961 | Keller | 206/45.21 X |
| 3,835,280 | 9/1974 | Gades et al. | 219/10.55 E |
| 3,941,967 | 3/1976 | Sumi et al. | 219/10.55 E |
| 4,306,133 | 12/1981 | Levinson | 219/10.55 E |
| 4,499,356 | 2/1985 | Hatagawa | 219/10.55 E |
| 4,555,605 | 11/1985 | Brown et al. | 219/10.55 E |

*Primary Examiner*—Philip H. Leung
*Attorney, Agent, or Firm*—James V. Harmon

[57] ABSTRACT

A microwave reflective energy concentrating stand is provided which consists of a horizontally disposed article supporting surface and a microwave reflector such as a sheet of metal foil spaced about ¼ of a wave length of the supplied microwave energy below the supporting surface. The stand can be formed from flexible packaging materials such as paperboard panels. The reflector is isolated electrically from the paperboard.

6 Claims, 7 Drawing Figures

MICROWAVE HEATING STAND WITH ELECTRICALLY ISOLATED REFLECTOR

FIELD OF THE INVENTION

The present invention relates to the microwave heating of foods and to an improved platform or stand for heating food more quickly and efficiently.

BACKGROUND OF THE INVENTION

Food that is heated in a microwave oven does not appear to couple well with the microwave energy in certain ovens. This causes less heating and poorer cooking results in certain ovens. For example, popcorn may not pop very well in some ovens. In virtually all home microwave ovens now manufactured, food is supported on a ceramic or glass shelf or false floor that is spaced an inch or two above the metal oven floor. The distance of the false floor above the metal floor of the oven varies from one manufacturer to another. In the course of developing the present invention, it was found that a standardized package of food was subjected to different heating conditions in different ovens. It was also determined that the amount of heating, i.e., the efficiency with which heat is induced into the food, appeared to be influenced by the height of the false floor from the microwave reflective metal floor of the oven.

The major objective of the present invention is to provide a compact, collapsible device that will asure more uniform heating of foods in a variety of microwave ovens of differing dimensions and will improve, speed up and generally facilitate the heating of foods but which is formed entirely from flexible or semiflexible packaging materials adapted to be withdrawn from a roll, printed, cut and formed like a conventional package so that little if anything is added to the cost of an ordinary package.

A number of devices have been previously proposed to assist in the heating of foods in a microwave oven. For example, U.S. Pat. No. 4,013,798 describes a box which forms a shield supporting a metal tray above a reflective bottom layer. However, the box extends over the top of the food and prevents microwave energy from reaching it from the top. The shielding effect of the box together with the loss of microwave energy through holes in the bottom layer tend to prevent microwave energy from reaching the food. Microwave energy is reflected away from both the top and bottom of the surrounding box.

U.S. Pat. Nos. 2,612,596 and 3,835,280 both propose microwave heating devices composed of blocks of dielectric material, e.g., plastic blocks having a sheet of metal beneath them. The blocks are bulky and plastic relatively expensive due to the large amount of plastic resin needed. More importantly the blocks of dielectric material deemed necessary for operation take up a great amount of space rendering the devices unsuited for use as a disposable unit in a light weight package.

In the development of the present invention it was found that aluminum foil reflectors bonded to paper or paperboard would arc, scorch or burn the paper. This was very objectionable to users especially when the paperboard was badly scorched, blackened or was smoking hot when the oven was opened.

A variety of prepared foods are now sold in the supermarket within a package specifically designed to contain the food that is heated in a microwave oven. To be sucessful, these packages must be composed of inexpensive, flexible or semiflexible packaging material such as paper, paperboard or foil capable of passing through conventional paper and paperboard converting equipment such as printers, sheet cutters and the like. One important object of the invention is to provide a reflective support to improve the heating of such packaged foods without adding much to their cost and to do so without burning, scorching or blackening the support or the food.

SUMMARY OF THE INVENTION

The present invention provides a microwave heating stand with an electrically isolated reflector for facilitating the heating of food in a microwave oven. The device is composed of a stand body formed from microwave transparent stiff or semiflexible packaging sheet material such as paperboard defining an upper supporting surface for supporting the food product and a lower microwave reflective sheet spaced below the supporting surface by a distance of about $\frac{1}{4}$ the wave length of the microwave energy supplied by the oven. The microwave reflective sheet can be an aluminum foil supported upon an electrically isolating support sheet such as plastic film suspended above a hole in the paperboard and being substantially aligned with the food supporting surface. The portion of the stand between the food supporting surface and the reflective surface is free from microwave reflective material. In this way, microwave energy from the oven strikes the microwave reflective sheet from above and is reflected upwardly therefrom whereby the reflective surface acts as an artificial oven wall and forms a region of concentrated phase-reinforced energy either inside or at the surface of the food article to thereby accelerate heating of the food at its surface or at a controlled depth within it. By isolating the foil reflector from the paperboard walls of the stand, it was discovered that the arcing, scorching, burning and possibility of fires is avoided.

THE FIGURES

DETAILED DESCRIPTION OF THE INVENTION

Figure 1:
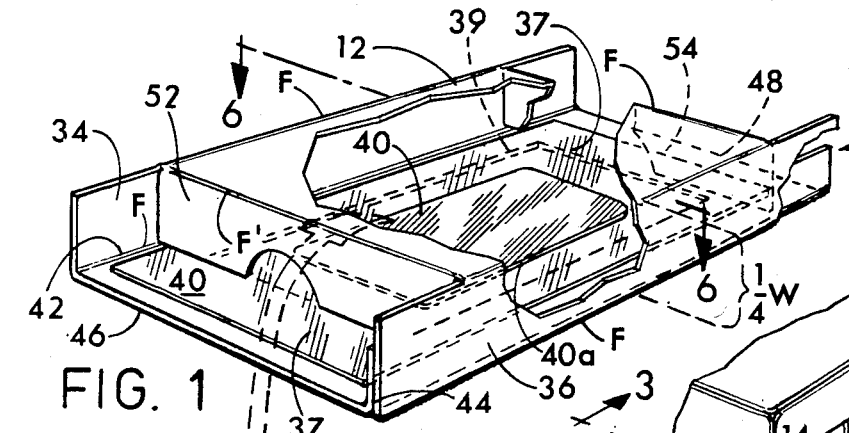
FIG. 1 is a perspective view of the invention set up ready for use.
Figure 2:
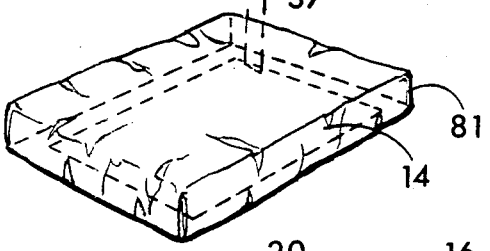
FIG. 2 is a perspective view of a microwave oven in which the invention is about to be used.
Figure 2:
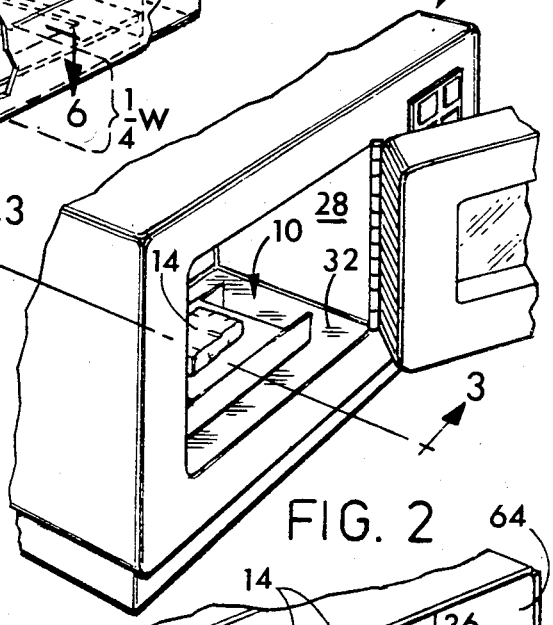
Figure 4:
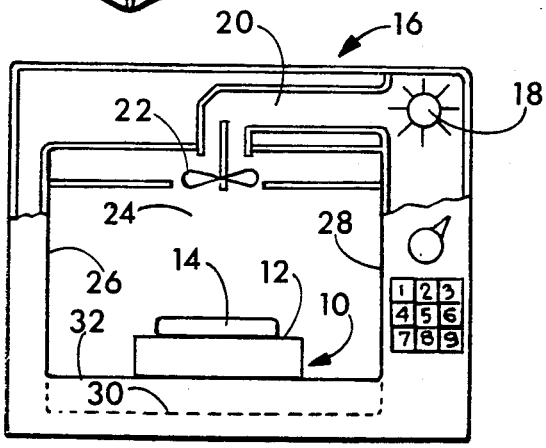
FIG. 4 is a front view of the oven in FIG. 2 partly broken away.
Figure 3:
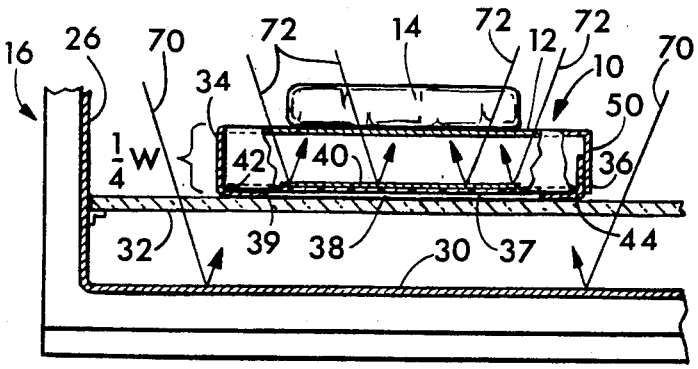
FIG. 3 is a transverse sectional view taken on line 3—3 of FIG. 2.
Figure 6:
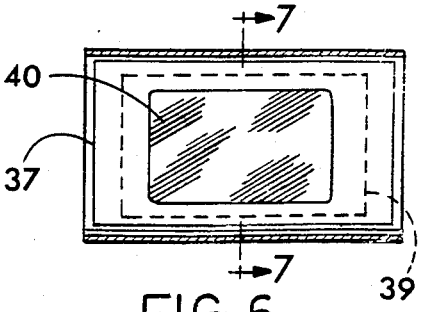
Figure 7:
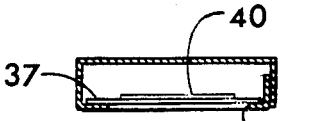

As shown in the figures, the invention concerns a collapsible stand or spacer indicated generally by the numeral 10. The stand 10 includes a flat upper supporting surface 12 for supporting a food product such as a package 14 of any of a variety of foods such as french fried or hash brown potatoes, hamburgers, pizza pie, unpopped popcorn or the like. When the food package 14 is to be heated, it is placed as shown by dotted lines in FIG. 1 on the supporting surface 12 of the stand 10 and is put in a microwave oven 16 having a microwave generator 18 as shown in FIGS. 2–4.

The support surface 12 is rectangular in this instance and and is spaced a predetermined distance; ¼ of the wave length W of the microwave generator 18 above a microwave reflective sheet 40. Thus, during operation the microwaves from the microwave generator or magnetron 18 pass through the guide 20 past a stirring device 22, all of conventional construction, into an oven cavity 24 which includes metal side walls 26 and 28, metal bottom wall 30, and a typically ceramic supporting shelf or false floor 32. The microwave oven 16 per se is entirely conventional and forms no part of the present invention but is described here in part so that the principles under which the invention operate can be more easily understood.

The stand 10 includes a pair of normally vertically disposed laterally spaced apart parallel side walls 34 and 36 which hold the top wall 12 a required distance from the bottom wall 38. The walls of the stand 10 are formed from stiff or semiflexible packaging material namely heavy paper, paperboard or cardboard. The bottom wall 38 is composed of a paperboard sheet having an opening 39 above which is bonded a rectangular sheet of microwave transparent electrically nonconductive sheet 37 that has little or no moisture content. A sheet of plastic such as polyester, nylon or cellophane is suitable. Bonded to the sheet 37 is a microwave reflective sheet 40 such as aluminum foil or other reflective sheet material that serves as a microwave energy reflector at the bottom of the stand. As can be seen in FIGS. 1 and 3, the microwave reflective sheet 40 includes a perimeter edge 40*a* that is smaller than the hole 39 and thus isolates the reflector 40 from the paperboard wall 38 of which the stand is composed.

It can be seen that the reflective sheet 40 extends over a substantial part of the width and breadth of the stand 10. It is spaced beneath he supporting surface 12 and is positioned substantially parallel to it. The stand 10 can be formed from a lightweight paperboard sheet divided into four rectangular panels connected together by means of fold lines F which form hinges. The two major panels comprise of the food supporting surface 12 and the bottom wall 38. A tab 50 is provided at one edge of the panel defining the supporting surface 12. The tab 50 is glued to the panel 36. A pair of tabs 52 and 54 are hinged to the front and rear edges of the panel 12 along integral fold lines $F^1$. When the tabs 52 and 54 are folded downwardly along the hinges formed by the fold lines $F^1$ to a vertical position, the stand 10 will be held in the upright or erect condition shown in FIG. 1. However, when the stand 10 is to be folded flat, the tabs 52 and 54 are simply folded up until they are parallel with the support surface 12 whereupon the stand can be collapsed, i.e., flattened to the configuration in FIG. 5. While the stand is inexpensive and thus disposable, it can be reused many times if desired.

Figure 5:
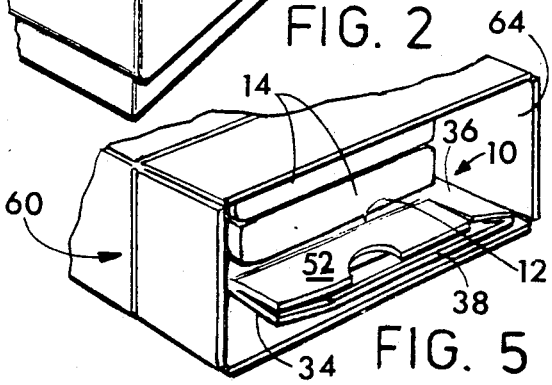
FIG. 5 is a partial perspective view of the package enbodying the invention and FIG. 6 is a horizontal sectional view taken on line 6—6 of FIG. 1 on a reduced scale and FIG. 7 is a vertical sectional view taken on line 7—7 of FIG. 6.

Refer now to FIG. 5 which illustrates a typical application of the invention. As shown in FIG. 5, the stand 10 is placed in a shipping container 60 such as a lightweight paperboard carton together with one or more prepackaged food products 14. It can be seen that the stand 10 is in a collapsed condition with the tabs 50 and 52 folded up to a horizontal position parallel with the product support surface 12. After the container 60 is opened, the stand 10 and the prepackaged food articles 14 are removed, in this case by sliding them out through the open end 64. The stand 10 is then erected by pressing on the fold lines F and bending the tabs 52 and 54 downwardly about the fold lines $F^1$ until they reach a vertical position thereby holding the stand 10 in the erect condition of FIGS. 1 and 3 ready for use. The stand is then placed in the oven on the false floor 32 and one of the prepackaged food articles 14 is placed on the support surface 12.

During operation, as shown in FIG. 3, microwave energy indicated by lines 70 will pass through the oven first past the stirrer 22 downwardly on either side of the support through the false floor 32 and will be reflected upwardly by the bottom wall 30 of the oven chamber. Some of the other microwave energy will pass downwardly through the food product as indicated by diagonal lines 72, the microwave energy striking conductive sheet 40, thereby reflecting microwave energy back up into the food product 14. It has been found that by placing the food product approximately ¼ of a wave length from the reflective surface 40, many of the waves reflected from the surface 40 will reach an energy maximum through phase reinforcement at approximately the lower surface of the food product or somewhat inside the food product. This is due to the microwave energy being reflected in phase from a reflective surface so that the waves reflected upwardly from the surface 40 are in phase and at maximum energy in proximity with supporting surface 12 thereby forming a high energy region in the vicinity of the food article 14, particularly in proximity with its lower surface or somewhat above its lower surface. In a typical microwave oven operating at a frequency of 2450 MZ, the wave length is 12 cm. and accordingly the height of the stand should be about 2.5 or 3 cm. If the height of the stand 10 is 3 cm., energy will peak at the surface 12. If it is 2.5 cm., it will peak inside the food product a distance of about ½ cm. In this way it can be seen that the reflective sheet 40 acts as an artificial oven floor forming a region of concentrated phase reinforced microwave energy either inside or at the surface of the food article 14 to thereby enhance and accelerate heating.

By reference is FIG. 3, it will be noticed that microwave radiation indicated by diagonal lines 72 in the region of the food product 14 will pass downwardly around the food product and through it, striking the upper surface of the reflective sheet 40. The wave energy will then be reflected upwardly a distance of approximately 3 cm. with the peak energy at approximately the interface betwen the food product 14 and the supporting surface 12. The wave reinforcement will peak at about the same plane. It should be noticed that regardless of the height of the false floor 32 of the oven 16, the same energy concentration will be provided very close to the lower surface of the food product.

In accordance with a variation of the invention, the stand 10 is itself used as a box or carton for the food article 14. The food article 14 is thus stored within the stand between the supporting surface 12 and the reflective surface 40. When the food article is to be heated, it is removed and placed on top of the support surface 12 and accordingly the stand has a dual purpose.

The invention has been found highly effective in facilitating efficient microwave heating. For example, in popping microwave popcorn in a Litton Sand 5 oven, the average final volume of the popped popcorn was increased from 650 cc. to an average of 1650 cc. Under similar circumstances, the same quantity of popcorn which reached an average of 1650 cc. after popping in a Panasonic 700 watt oven showed an average increase to 2150 cc. using the invention, a 30% improvement.

In addition, the stand 10 is completely collapsible, has an extremely low mass and is formed from readily available packaging materials that can be printed, cut, glued and formed using conventional paper processing equipment.

Furthermore, food is heated consistently regardless of how far the false floor 32 is located from the floor 30 of the oven. Typically, the shelf 32 is 5 cm. from the floor 30 of a Litton Sand 5 oven, 1.5 cm. in a Panasonic 700 watt oven, 3 cm. in a Samsung oven and about 7 cm. in a Tappan consumer oven. However, when the invention is used, consistent and rapid heating can be obtained with the same good results in each of the ovens without burning, scorching, arcing or blackening the stand or the food.

In a modified form of the invention the support sheet 37 is larger and is connected directly to other panels such as the side panels 34 and 36 and the lower panel 38 is eliminated.

Many other variations of the invention within the scope of the appended claims will be apparent to those skilled in the art once the principles of the invention described above are understood.

What is claimed is:

1. A foldable and collapsible microwave heating stand that can be shipped flat in a food package and erected to provide a support for facilitating the heating of food in a microwave oven comprising, a body formed of hinged panels composed of paper or paperboard including a lower panel, side panels and an upper panel defining an upper support surface for supporting a food article thereon, said lower panel being spaced below the supporting surface by a distance of about ¼ wave length of the microwave energy supplied by the oven, whereby when said microwave energy has a wavelength of 12 cm. said distance between the upper and lower panels is about 2.5 to 3 cm., a microwave reflective sheet substantially aligned below the support surface, said lower panel having an opening, an electrically non-conductive moisture free support sheet bonded across the opening and said reflective sheet being bonded to the support sheet and being smaller than the opening so as to be thereby isolated electrically from the paper or paperboard, whereby microwave energy from the oven striking the reflective sheet from above is reflected upwardly therefrom such that the reflective surface acts as an artificial oven floor forming a region of concentrated phase-reinforced microwave energy inside the food or at the surface of the food article resting upon said upper support surface to thereby enhance the heating of the food and the isolation of the reflective sheet from the paper or paperboard inhibits scorching, arcing or burning around the reflective sheet.

2. The stand of claim 1 wherein said stand is formed from a plurality of panels of microwave transparent sheet material connected by integral paper or paperboard hinges at intersecting edges which are parallel to one another to define a stand that is adapted to be folded flat for compact storage and shipment in said package by folding the stand at the parallel hinges to a flattened condition.

3. The stand according to claim 2 wherein the stand comprises a rectangular normally horizontally disposed panel defining the supporting surface, a rectangular horizontally disposed panel defining the lower panel and a pair of vertically disposed side panels connected by means of said hinges between the upper and lower panels and each side panel having a height of about 2.5 to 3 cm.

4. The stand of claim 3 wherein the stand includes moveable tabs hinged thereto for folding to an operative position to maintain the stand in an erect condition.

5. A foldable and collapsible microwave heating stand that can be shipped flat in a food package and erected to provide a support for facilitating the heating of food in a microwave oven comprising, a body formed of hinged panels composed of paper or paperboard including a lower surface defining a base, two side panels, and an upper support surface for supporting a food article thereon, said lower surface being spaced below the upper food supporting panel by a distance of about ¼ wave length of the microwave energy supplied by the oven, whereby when said microwave energy has a wavelength of 12 cm. said distance is about 2.5 to 3 cm., a microwave reflective sheet carried on the lower surface of the body, said lower surface including an electrically non-conductive moisture free sheet bonded to the body and supporting the reflective sheet to isolate the reflective sheet from the paper or paperboard sheet material, whereby microwave energy from the oven striking the reflective sheet from above is reflected upwardly therefrom such that the reflective surface acts as an artificial oven floor forming a region of concentrated phase-reinforced microwave energy inside the food or at the surface of the food article resting upon said upper support surface to thereby enhance the heating of the food and the electrical isolation of the reflective sheet from the paper or paperboard inhibits scorching, arcing or burning around the reflective sheet.

6. The stand of claim 5 wherein the moisture-free sheet is a polyester film.

* * * * *